US007140449B1

(12) United States Patent
Ebner

(10) Patent No.: US 7,140,449 B1
(45) Date of Patent: Nov. 28, 2006

(54) AIR BLOWER FOR EXTINGUISHING FIRES AND METHOD FOR EXTINGUISHING FIRES

(76) Inventor: Edwin D. Ebner, 32 John St., New City, NY (US) 10956

( * ) Notice: Subject to any disclaimer, the term of this patent is extended or adjusted under 35 U.S.C. 154(b) by 741 days.

(21) Appl. No.: 09/710,815

(22) Filed: Nov. 10, 2000

(51) Int. Cl.
*A62C 35/00* (2006.01)

(52) U.S. Cl. ..... 169/12; 169/45; 169/46; 169/49; 169/52; 169/70; 239/129; 239/152; 239/289; 239/578

(58) Field of Classification Search ..... 169/45, 169/46, 48, 49, 11, 91, 51, 52, 12, 54, 70; 239/128, 129, 289, 152–154, 578, 581.1, 239/505, 507; 137/872, 875
See application file for complete search history.

(56) References Cited

U.S. PATENT DOCUMENTS

| | | | | | |
|---|---|---|---|---|---|
| 808,397 | A * | 12/1905 | Meakin | 137/875 |
| 1,849,411 | A * | 3/1932 | Silva et al. | 169/91 |
| 1,863,920 | A * | 6/1932 | Costa | 169/91 |
| 2,884,075 | A * | 4/1959 | Poon | 169/48 |
| 2,891,624 | A * | 6/1959 | McBride | 169/91 |
| 3,319,650 | A * | 5/1967 | Peterson | 137/561 R |
| 3,481,405 | A * | 12/1969 | Ward | 239/129 |
| 4,203,423 | A * | 5/1980 | Ricci | 137/871 |
| 4,388,766 | A * | 6/1983 | Sanderson | 137/875 |
| 4,614,237 | A * | 9/1986 | Colodner et al. | 239/129 |
| 4,669,548 | A * | 6/1987 | Colodner et al. | 169/12 |
| 4,718,457 | A * | 1/1988 | Luger | 137/875 |
| 4,773,215 | A * | 9/1988 | Winberg et al. | 60/324 |
| 5,452,578 | A * | 9/1995 | Barber | 60/324 |
| 5,575,341 | A * | 11/1996 | Baker et al. | 169/70 |
| 5,641,024 | A * | 6/1997 | Lopez Alvarez | 169/91 |
| 5,836,398 | A * | 11/1998 | White | 169/54 |
| 5,848,652 | A * | 12/1998 | Bennett | 169/12 |
| 5,980,059 | A * | 11/1999 | Chi | 362/96 |
| 6,182,699 | B1 * | 2/2001 | Hawkes | 137/875 |

* cited by examiner

*Primary Examiner*—Steven J. Ganey
(74) *Attorney, Agent, or Firm*—Donald E. Marshall

(57) ABSTRACT

The invention employs a blower of the type used by commercial landscapers. The device has an engine mounted on a frame. Shoulder straps attached to the frame allow the user to wear the device on his back leaving the hands of the operator free to operate other tools such as a chain saw or perform other tasks. Also, wearing the device on the back makes it easier to transport the device over long distances to the source of the fire or backfire to be started.

The device's blower generates a stream of air at high speeds. This stream of air can be used to feed a fire when the air is directed at a fire. When used to extinguish a fire, air from the blower is tapped from a point 180 degrees removed from the blower output and mixed with exhaust from the engine. This mixture is diverted through a Y-shaped valve into the airstream coming out of the blower. When the device is used to start backfires a fire is started. The airstream, without the mixture of air and engine exhaust can be used to both encourage the propagation of the fire and direct the fire towards the main wild fire. The ability to quickly spread the backfire in the proper direction is imperative because a sudden change in wind direction or other weather conditions could cause the backfire to become as big a problem as the original fire.

24 Claims, 4 Drawing Sheets

AIR BLOWER FOR EXTINGUISHING FIRES AND METHOD FOR EXTINGUISHING FIRES

BACKGROUND OF THE INVENTION

Field of the Invention

A device for extinguishing fires and a method of extinguishing fires.

BACKGROUND OF THE INVENTION

Description of the Prior Art

Every year, wild fires burn across the United States. Vast areas of forest land in the American mid-west such as Montana, Idaho and Wyoming burn every year. These fires are started by campers being careless with camp fires and lightning. The wild fires often spread quickly and threaten towns, homes and property.

In the year 2000 alone, 27,000 fire fighters combated 73,000 separate fires. These fires claimed over 6.3 million acres. The cost of fighting these wild fires is estimated to be 1 billion dollars. The total economic loss from fires, including property damages and loss of businesses, is estimated to be 10 billion dollars. More importantly, every year, many fire-fighters lose their lives combating the blazes.

Many types of equipment are used to combat wild fires. An effective tool is the use of airplanes to drop fire retardant chemicals and water on the affected area. Water is used to extinguish the blaze, whereas fire retardant chemicals are used to stop the advancement of the fire. Regardless of the advancement in firefighting equipment, the most work is done by fire-fighters on the ground.

Firefighters combat the blaze by extinguishing the fire directly or starting a backfire. A backfire is the controlled burn of forest in advance of the forest fire. By burning the land, a fire line is created. When the forest fire advances to the area burnt by the backfire, it can no longer advance for lack of fuel. Once a fire line is created by a backfire, the main blaze is allowed to burn itself out. This method is effective because the firefighters do not have to come in close proximity to the wild fire. However, backfires must be properly executed or they will become as great a problem as the original fire. It is important that the backfire advance in a direction toward the main forest fire. A sudden shift in winds can prevent the proper advancement of a backfire.

Firefighters on the ground use tools such as chain saws to create proper conditions for starting a backfire. Trees and heavy brush are cut and set ablaze when the conditions are optimal to cause a backfire to advance in a direction toward the main fire.

The prior art discloses several different types of apparatus using the exhaust of an engine to combat a fire. One such example is disclosed in U.S. Pat. No. 4,614,237 (Colodner et al.). Colodner et al. discloses a combination fire extinguisher and blower. An internal combustion engine powers the blower and includes a hose coupled to the exhaust pipe cover and the air inlet of the blower. The hose pipe exhausts gas into the blower when such gas is needed to extinguish a fire. A second hose is provided on the blower having one end secured to a sleeve fastened to an air cooled nozzle and is used to blow air or exhaust gas, whenever needed.

U.S. Pat. No. 5,848,652, issued to Bennett, discloses a fire suppression system for an engine compartment of a vehicle. A remotely controlled throttle valve disposed within the exhaust duct of the engine selectively diverts exhaust gas through a bypass duct for mixing with ventilation air flow.

By mixing the gases and the air flow, the oxygen content is reduced in the air flow over the engine. The reduced oxygen content will inhibit combustion.

Another prior art device is disclosed in U.S. Pat. No. 5,154,238, issued to Buchan. Buchan discloses a fire protection apparatus having spray nozzles oriented adjacent engines of an airplane. Quick connect coupling secure a conduit to the spray nozzles and deliver a fire extinguishing agent such as carbon dioxide directly to the engine to extinguish a fire.

SUMMARY OF THE INVENTION

It is an object of the invention to provide a firefighting tool that can be used for both extinguishing fires and starting backfires.

It is another object of the invention to provide a firefighting tool that can be carried on the firefighter's back to leave the hands free for other tasks.

It is yet another object of the invention to provide a lightweight inexpensive but effective firefighting tool.

It is another object of the invention to provide a method for extinguishing fires including operating a blower having an engine and an output hose creating an output of air through the output hose to form an airstream, diverting exhaust from the engine into said airstream and directing the airstream at the fire.

It is still another object of the invention to provide a method for starting backfires including operating a blower, the blower having an engine and an output hose, creating an output of air through the output hose to form an airstream, starting a backfire, and using the airstream of the blower to promote the spread of the backfire and direct the advancement of the backfire.

It is another object of the invention to provide a device for extinguishing fires or starting backfires having an engine to create an air flow, an output hose to direct the air flow and a valve for selectively adding exhaust from the engine to the air flow.

It is yet another object of the invention to provide a diverter valve within a Y-shaped valve of a blower, the valve acts to direct the exhaust of the blower to the output hose of the blower or to an exhaust outlet.

These and other objects of the invention will be apparent to one of ordinary skill in the art after reading the description of the invention that follows.

The invention resembles a blower used by commercial landscapers. The device has an engine mounted on a frame. Shoulder straps attached to the frame allow the user to wear the device on his back. This leaves the hands free to operate the blower or other tools such as a chain saw or perform other tasks. Also, wearing the device on the back makes it easier to transport the device over long distances to the source of the fire or backfire to be started.

The device generates a stream of air at high speeds. This stream of air can be used to blow out a fire when the air is directed at the source of the fire. When used to extinguish a fire, exhaust from the engine is diverted through a Y-shaped valve into the airstream. This has a twofold affect as it increases the speed of the airstream and increases the amount of carbon monoxide and carbon dioxide in the airstream to starve the fire of oxygen.

The device can also be used to start backfires. After the appropriate location of a backfire has been selected, a fire is started. The airstream created by the device can be used to both encourage the propagation of the fire and direct the fire towards the main wild fire. The ability to quickly spread the backfire in the proper direction is imperative because a sudden change in wind direction or other weather conditions could cause the backfire to become as big a problem as the original fire.

In one aspect of this invention there is provided a method of extinguishing a fire. The method comprises the steps of operating a blower, said blower having an engine and an output hose, creating an output of air from the engine to form an air stream, diverting exhaust from said engine into said air stream, and directing said air stream with the output hose at the fire.

In another aspect of this invention there is provided a method of starting back fires. The method comprising the steps of starting a fire, operating a device to create an air stream, directing said air stream at said fire, and causing the fire to spread in a controlled manner.

In yet another aspect of this invention there is provided a valve. The valve includes an input port and at least two output ports. There is also provided a planar valve member for selectively diverting gas into one of the two output ports. Additionally there is a planar valve member pivotally connected at the junction of the input and two exhaust outputs. There is also means for pivotally moving the planar valve member from a first position to a second position to slectively block the flow of the gas between the first or second exhaust output ports.

In yet another embodiment of this invention there is provided a device for extinguishing fires and starting back fires. The device comprises an engine. The engine creates an air stream and an exhaust. An air output hose is used for directing the air stream at a fire or back fire. At least one hose for selectively diverting the exhaust into the air stream.

In still a further aspect of this invention there is provided a valve having an input port and two output ports. The valve comprises a shutter body and a pivot pin. The shutter body is secured to the pivot pin. A valve rod is connected to and extended from the pivot pin. A cable is attached to the valve rod and moves the valve shutter body from a first position, blocking one output port, to a second position unblocking the first output port and blocking the second output port.

DETAILED DESCRIPTION OF THE INVENTION

Figure 1:
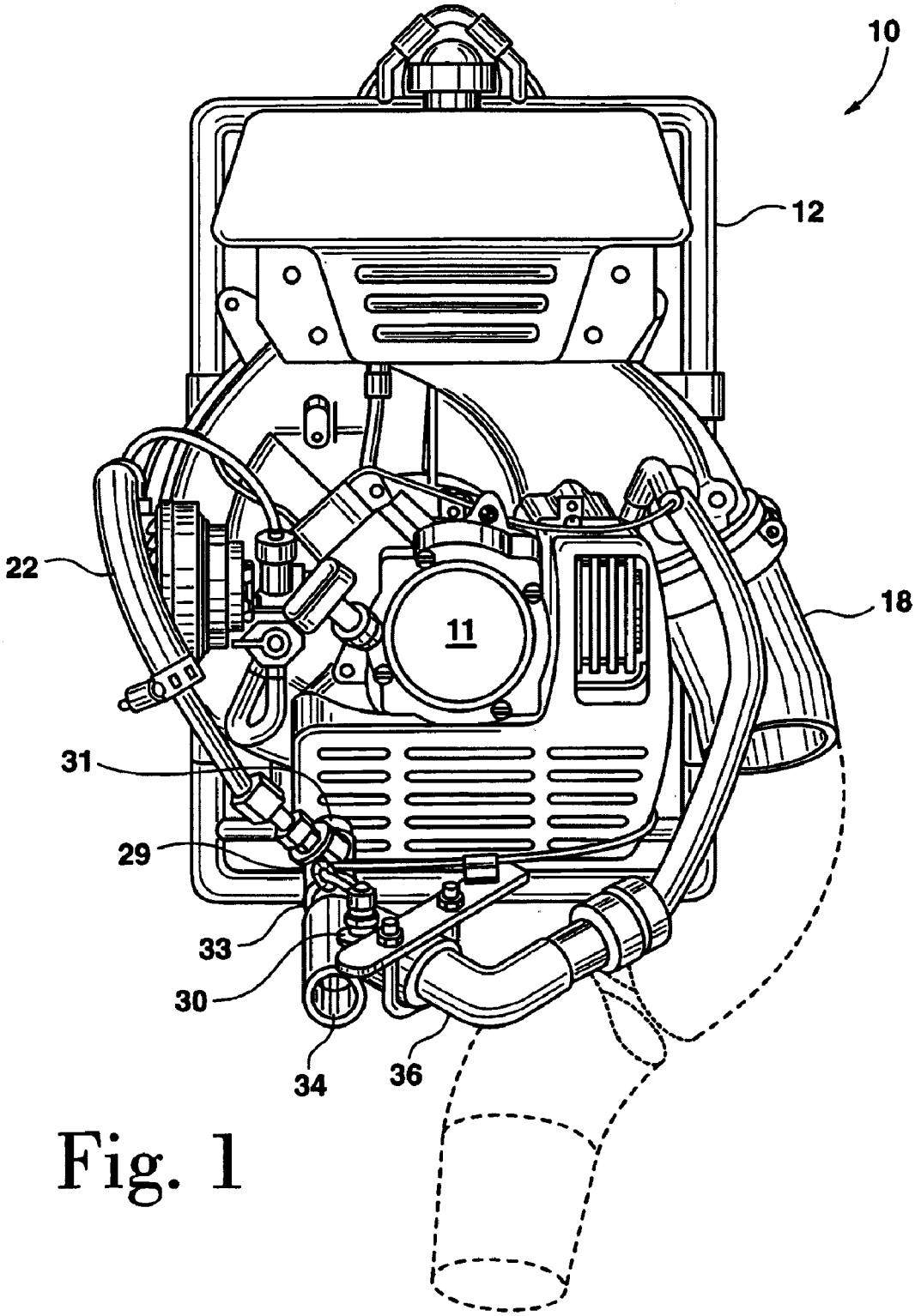
FIG. 1 is a front view of the device.

The device is clearly depicted in FIG. 1. The device is a blower 10 having an engine 11 to create an airstream. The blower 10 is attached to a frame 12, as is well known in the art. The blower 10 may have an air outlet hose 18. The air outlet hose 18 allows the user to direct the generated airstream.

Figure 4:
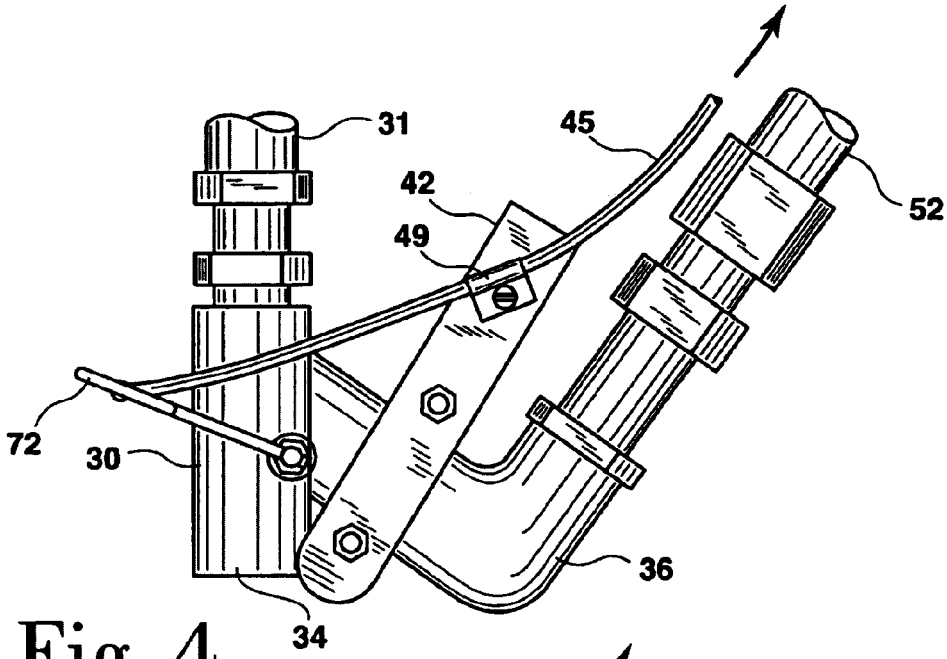
FIG. 4 is a view of the Y-shaped valve.

A Y-shaped valve 30 comprising an input leg 33 and first and second output exhaust legs 34 and 36, respectively. Exhaust, created by the internal combustion of the engine 11, may flow through an exhaust output pipe 31 which is connected to the input leg 33 of the Y-shaped valve 30. The exhaust output pipe 31 connects to the exhaust input leg 33 (FIGS. 5 and 6) of a Y-shaped valve 30 comprising an input leg 33, and a first and second output exhaust legs 34 and 36, respectively. A conduit 22 may be connected to a port (not shown) in the blower 10 approximately 180° before the outlet hose 18. Conduit 22 may be coupled by a T-connection 29 (FIGS. 1 and 2) to the engine exhaust pipe 31 (FIG. 4). The Y-shaped valve 30 receives the supply of air from the blower 10 from T couple 29. The air cools and speeds the flow of the exhaust gas as will be explained later.

The exhaust gas and air enters the Y-shaped valve 30 and may exit the Y-shaped valve 30 through the first output leg 34 (FIGS. 5 and 6) to the atmosphere or may be diverted to the second output exhaust leg 36 of the Y-shaped valve 30 into the blower 10 where the airstream is about to exit outlet hose 18.

Figure 2:
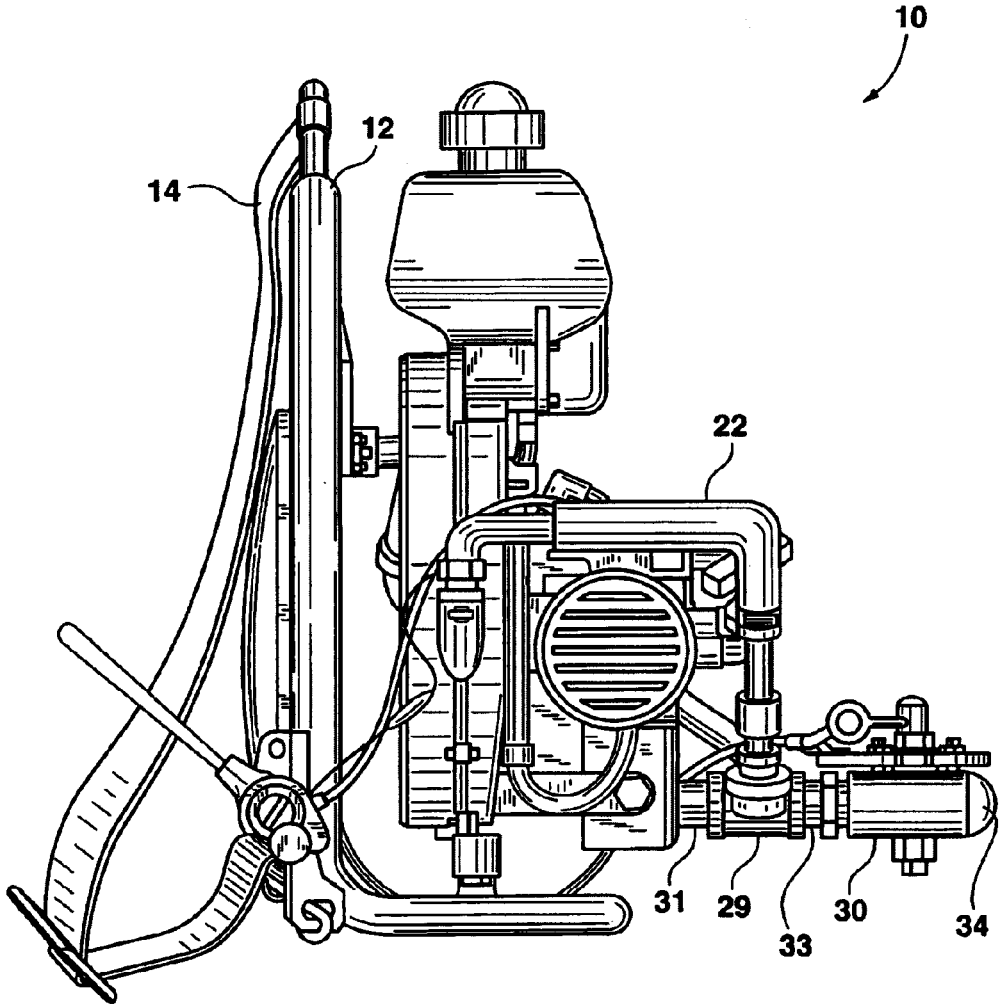
FIG. 2 is a view of the left side of the device.

FIG. 2 shows the left side of the device. As may be seen in this view, the device has shoulder straps 14 attached to the frame 12 to allow the operator to carry the device on his back. The orientation and location of the Y-shaped valve 30 prevents the exhaust exiting either of the two exhaust legs 34 or 36 from interfering with the breathing of the operator.

Figure 3:
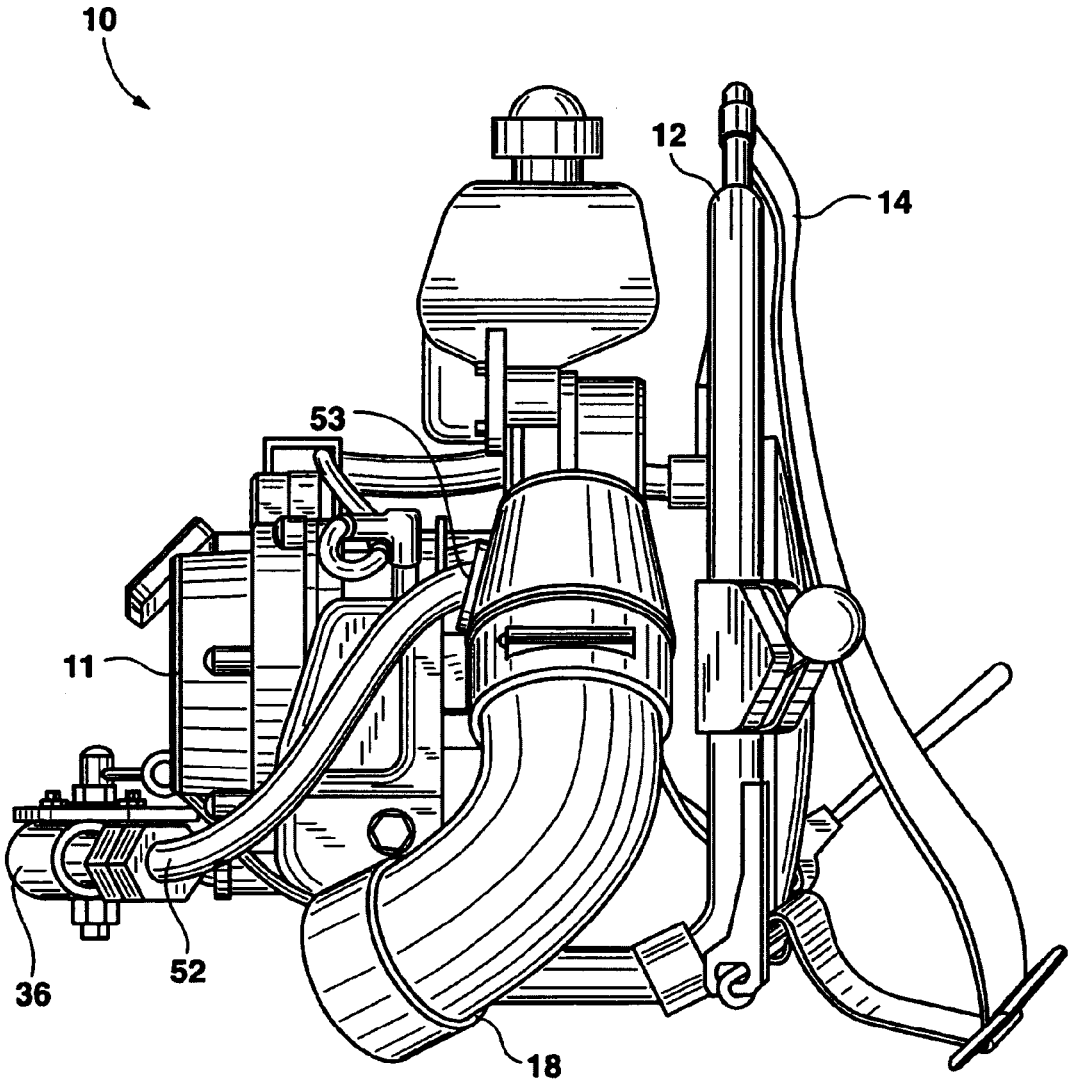
FIG. 3 is a view of the right side of the device.

The right side of the device, as shown in FIG. 3, shows the air outlet 18 of the blower 10. The engine exhaust may be diverted by the Y-shaped valve 30 through the second exhaust leg 36 which may be coupled to an exhaust delivery hose 52. The other end of the delivery hose 52 is connected to a port or opening 53 in the housing of the blower 10 at a point just before the air outlet 18. In this way, exhaust gasses may be delivered into the airstream created by the blower 10 thereby increasing the flow of the output gases as well as adding such flame retarding exhaust constituents as carbon monoxide and carbon dioxide to the exhaust stream.

The diversion of the exhaust is more fully explained with reference to FIG. 4. The exhaust input leg 31 of the Y-shaped valve 30 may be selectively connected to the first or second exhaust output leg 34 or 36, respectively. Attached to the second exhaust output leg 36 is, as previously discussed, the exhaust delivery hose 52. A control element such as a flapper valve or shuttle 62 may be pivotally secured by a pivot pin 64 or the like at the Y junction of the Y-shaped valve 30. The valve member 62 may be used to determine whether the exhaust and airstream combination passes to outlet hose 18 of blower 10 or passes directly through the first exhaust leg 34. Alternatively, well known valve constructions may be used in place of the Y-shaped valve 30 (e.g., ball or slider valves).

A valve rod 72 may connected, at one end, to a flexible valve actuating cable 45. Such cables are well known in the art. A bracket 42 may be secured to the second exhaust output leg 36. A cable guide 49, again, well known in the art, may be attached to the bracket 42 for receiving and supporting the cable 45. The cable 45 extends through the guide 49. The guide 49 insures smooth operation of the cable 45, as is well known in the art. Movement of the cable 45, in turn, moves the rod 72 to affect movement of the flapper valve 62.

Figure 5:
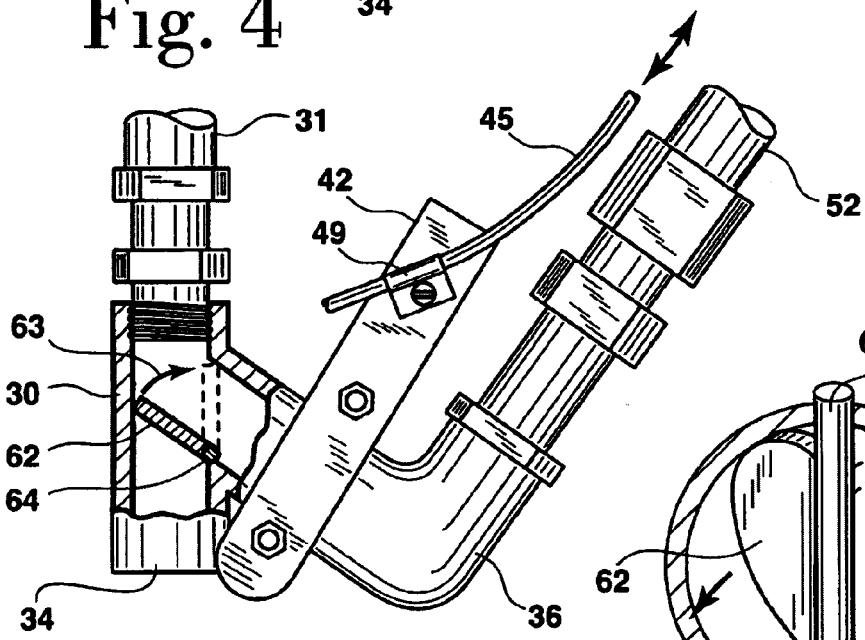
FIG. 5 is a view of the Y-shaped valve with portions cut away to show operation of the valve.
Figure 6:
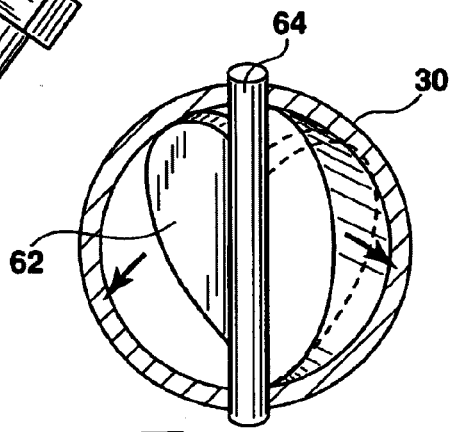
FIG. 6 is a view of the valve within the Y-shaped valve.

The combination of the Y-shaped valve 30 with the flapper valve 62 is better seen with reference to FIGS. 5 and 6 which provide a sectional view of the Y-shaped valve 30 in the vicinity of the flapper valve 62. Thus, as previously indicated the Y-shaped valve 30 has therewithin a shutter valve body 62 connected to a pivot pin 64. The valve rod 72 is connected to the pivot pin 64. Movement of the rod 72 may be caused by actuation of the cable 45. The shutter 62 may be connected to the pivot pin 64 to move the shutter from a first position, shown in FIG. 5, to a second position, shown in phantom in FIG. 5 in the direction of the arrow 63. In the first position, the exhaust and air coming through exhaust intake leg 32 is diverted into the second exhaust leg 36. The exhaust delivery hose 52 then carries the mixture of exhaust and air from the second exhaust leg 36 to the juncture 53 with the blower 10 just before the air outlet hose 18. When the shutter valve 62 is moved to the second position (shown in phantom) the exhaust and air combination flows directly from the exhaust pipe 32 through the first exhaust outlet pipe 34.

In operation, the blower 10 generates a stream of air which exits outlet hose 18 at a substantially constant velocity. When the Y-valve 30 diverts the mixture of exhaust and air through conduit 52 and into the outlet hose 18, the resulting stream is increased in velocity. Further, air propels the air-engine exhaust at greater velocity than if the exhaust alone were used.

The combined exhaust and airstream, exiting the outlet hose 18, can be used to blow out a fire when the air is directed at the source of the fire. When used to extinguish a fire, exhaust from the engine 11, mixed with air from the blower 10, is diverted through the Y-shaped valve 30 into the blower airstream just before the outlet hose 18. This has a twofold affect: it increases the speed of the airstream and increases the amount of carbon monoxide and carbon dioxide in the airstream to help starve the fire of oxygen.

The device can also be used to start backfires. After the appropriate location of a backfire has been selected, a fire is started. The airstream (without the addition of the exhaust) created by the blower 10 can be used to both encourage the propagation of the fire and direct the fire towards the main wild fire. The ability to quickly spread the backfire in the proper direction is imperative because a sudden change in wind direction or other weather conditions could cause the backfire to become as big a problem as the original fire.

Yet another use for this device is contain small chemical or oil spills by using the blower 10 to divert the liquid to a safer area.

While the invention has been described with reference to a preferred embodiment, modifications and variations would be obvious to one of ordinary skill in the art without departing from the scope of the invention. The exact description of the invention is not intended to be limiting in any way but to cover these modifications and variations.

What is claimed is:

1. A fire extinguishing apparatus comprising:
an engine adapted to generate exhaust;
a valve comprising:
an exhaust input leg in communication with and adapted to receive exhaust from the engine;
a first exhaust output leg;
a second exhaust output leg; and,
a valve member adapted to selectively control exhaust flow from the exhaust input leg to the first exhaust output leg and the second exhaust output leg;
a control element adapted to control the valve member, the control element comprising:
a rod coupled to the valve member and adapted to facilitate movement of the valve member; and,
a cable coupled to the rod and adapted to facilitate movement of the rod; and,
an outlet hose in communication with and adapted to receive exhaust from the second exhaust output leg, the outlet hose being directionally controllable.

2. The fire extinguishing apparatus of claim 1 further comprising:
a bracket coupled to the fire extinguishing apparatus; and,
a cable guide coupled to the bracket adapted to receive and support the cable.

3. The fire extinguishing apparatus of claim 1 wherein the valve member is a flapper valve.

4. The fire extinguishing apparatus of claim 1 wherein the valve is a ball valve.

5. The fire extinguishing apparatus of claim 1 wherein the valve is a slider valve.

6. The fire extinguishing apparatus of claim 1 wherein an output of the first exhaust output leg is directed substantially away from the fire extinguishing apparatus.

7. A fire extinguishing system comprising:
a frame;
a blower adapted to generate an airstream coupled to the frame, the blower comprising:
an engine adapted to generate exhaust; and,
an outlet hose adapted to conduct the airstream, the outlet hose being directionally controllable;
a valve comprising:
an exhaust input leg in communication with and adapted to receive exhaust from the engine;
a first exhaust output leg;
a second exhaust output leg; and,
a valve member adapted to selectively control exhaust flow from the exhaust input leg to the first exhaust output leg and the second exhaust output leg; and,
wherein the outlet hose is in communication with and adapted to receive exhaust from the second exhaust output leg and facilitates combination of the exhaust from the engine and the airstream from the blower.

8. The fire extinguishing system of claim 7 further comprising:
one or more straps coupled to the frame and adapted to allow carriage of the fire extinguishing system.

9. The fire extinguishing system of claim 7 further comprising:
a control element adapted to control the valve member.

10. The fire extinguishing system of claim 9 wherein the control element comprises:
a rod coupled to the valve member and adapted to facilitate movement of the valve member; and,
a cable coupled to the rod and adapted to facilitate movement of the rod.

11. The fire extinguishing system of claim 10 further comprising:
a bracket coupled to the fire extinguishing system; and,
a cable guide coupled to the bracket adapted to receive and support the cable.

12. The fire extinguishing system of claim 7 wherein the valve member is a flapper valve.

13. The fire extinguishing system of claim 7 wherein the valve is a ball valve.

14. The fire extinguishing system of claim 7 wherein the valve is a slider valve.

15. The fire extinguishing system of claim 7 wherein an output of the first exhaust output leg is directed substantially away from the fire extinguishing system.

16. A method of extinguishing a fire comprising:
generating an airstream with a blower;
flowing the airstream through an outlet hose;
generating exhaust from an engine of the blower;
selectively directing at least a portion of the exhaust through an exhaust output leg of a valve having at least two exhaust output legs;
delivering the exhaust into the outlet hose;
combining the airstream and the exhaust in the outlet hose;
propelling the combined airstream and exhaust through the outlet hose.

17. The method of claim 16 further comprising:

reducing a temperature of one or more components of a fire extinguishing apparatus by flowing the combined airstream and exhaust through the apparatus.

18. The method of claim 16 further comprising:

selectively directing at least a portion of the exhaust through an output of another exhaust output leg to atmosphere.

19. The method of claim 16 further comprising:

starving a fire of oxygen by propelling at least exhaust through the outlet hose at the fire.

20. The method of claim 16 further comprising:

propelling the combined airstream and exhaust through the outlet hose to divert a liquid.

21. A method of extinguishing a fire comprising:

generating an airstream with a blower;

flowing the airstream through an outlet hose;

generating exhaust from an engine of the blower;

selectively directing at least a portion of the exhaust through an exhaust output leg of a valve having at least two exhaust output legs;

directing the exhaust to atmosphere; and, propelling the airstream through the outlet hose.

22. The method of claim 21 further comprising:

encouraging propagation of a backfire by propelling the airstream at the backfire.

23. The method of claim 21 further comprising:

directing a backfire toward a fire by propelling the airstream at the backfire.

24. The method of claim 21 further comprising:

propelling the airstream through the outlet hose to divert a liquid.

* * * * *